US008397818B2

(12) United States Patent
Osaland et al.

(10) Patent No.: US 8,397,818 B2
(45) Date of Patent: Mar. 19, 2013

(54) METHOD AND DEVICE FOR CLEANING A CAVITY IN A PETROLEUM WELL

(75) Inventors: Espen Osaland, Sandnes (NO); Lasse Haugland, Bryne (NO)

(73) Assignee: Aker Well Service AS, Stavanger (NO)

( * ) Notice: Subject to any disclaimer, the term of this patent is extended or adjusted under 35 U.S.C. 154(b) by 8 days.

(21) Appl. No.: 13/133,343

(22) PCT Filed: Dec. 7, 2009

(86) PCT No.: PCT/NO2009/000420

§ 371 (c)(1),
(2), (4) Date: Jun. 7, 2011

(87) PCT Pub. No.: WO2010/068111

PCT Pub. Date: Jun. 17, 2010

(65) Prior Publication Data

US 2011/0232911 A1 Sep. 29, 2011

(30) Foreign Application Priority Data

Dec. 9, 2008 (NO) ..... 20085105

(51) Int. Cl.
*E21B 37/00* (2006.01)
*E21B 23/03* (2006.01)

(52) U.S. Cl. ..... 166/311; 166/299

(58) Field of Classification Search ..... 166/311, 166/170, 299, 177.1, 177.2, 222; 102/319, 102/310, 313; 89/1.15
See application file for complete search history.

(56) References Cited

U.S. PATENT DOCUMENTS

| | | | | | |
|---|---|---|---|---|---|
| 1,652,650 | A * | 12/1927 | Watson et al. | 166/227 |
| 2,362,829 | A * | 11/1944 | Kinley | 102/313 |
| 2,414,349 | A * | 1/1947 | Alexander | 166/299 |
| 3,721,297 | A * | 3/1973 | Challacombe | 166/299 |
| 3,965,979 | A * | 6/1976 | Lamb | 166/117.5 |
| 3,986,558 | A * | 10/1976 | Dufour | 166/303 |
| 4,033,409 | A * | 7/1977 | Hebert | 166/117.5 |
| 4,064,935 | A * | 12/1977 | Mohaupt | 166/63 |
| 4,611,673 | A * | 9/1986 | Childers et al. | 175/340 |
| 4,757,863 | A * | 7/1988 | Challacombe et al. | 166/299 |
| 4,919,204 | A * | 4/1990 | Baker et al. | 166/223 |
| 5,137,085 | A * | 8/1992 | Goode | 166/117.5 |
| 5,195,585 | A * | 3/1993 | Clemens et al. | 166/222 |
| 5,429,036 | A * | 7/1995 | Latos | 91/181 |
| 5,636,691 | A * | 6/1997 | Hendrickson et al. | 166/278 |
| 5,690,171 | A * | 11/1997 | Winch et al. | 166/63 |
| 6,273,187 | B1 * | 8/2001 | Voisin et al. | 166/63 |
| 6,598,682 | B2 * | 7/2003 | Johnson et al. | 166/370 |
| 7,306,038 | B2 * | 12/2007 | Challacombe | 166/299 |
| 2004/0238167 | A1 * | 12/2004 | Pinto et al. | 166/255.2 |
| 2005/0167108 | A1 * | 8/2005 | Chang et al. | 166/298 |
| 2006/0076131 | A1 * | 4/2006 | Challacombe | 166/256 |
| 2006/0185898 | A1 * | 8/2006 | Seekford | 175/4.6 |

* cited by examiner

*Primary Examiner* — Daniel P Stephenson
(74) *Attorney, Agent, or Firm* — Gablegotwals

(57) ABSTRACT

A method and a device for removing sediment or other undesired material (28) from a cavity (24) in a petroleum well (2) in which a tool (30) is moved down into the petroleum well (2). The method including placing a detonable charge (34) in the tool (30) and detonating the charge (34) after the tool (30) has been positioned in the petroleum well (2).

7 Claims, 1 Drawing Sheet

II-II

METHOD AND DEVICE FOR CLEANING A CAVITY IN A PETROLEUM WELL

CROSS-REFERENCE TO RELATED APPLICATIONS

This application is the United States National Phase of PCT Patent Application No. NO2009/000420 filed on 7 Dec. 2009, which was published in English on 17 Jun. 2010 under Publication No. WO 2010/068111 A1, which claims priority to Norwegian Patent Application No. 20085105 filed 9 Dec. 2008, both of which are incorporated herein by reference.

This invention relates to a method of cleaning a cavity in a petroleum well. More particularly, it relates to a method of removing sediment or other undesired material from a cavity in a petroleum well, in which a tool is moved down into the well. The invention also includes a device for practising the method.

The invention is explained below with reference to a gas lift valve as the problems related to such a valve adequately shows the tasks that are solved by means of the method and device provided. However, the method and its application are not restricted to this purpose in any way.

During petroleum production it is necessary in some reservoirs to pump gas in to achieve so-called gas lift. The gas is pumped down the borehole, flowing via one or more gas lift valves into the tubing. It is usual to place the gas lift valve in a side pocket in the tubing to be able to replace the valve stem of the gas lift valve by means of a kick-over tool while, at the same time, there is free passage for other tools past the gas lift valve.

A prior art kick-over tool is often formed as a wire line tool. When a valve stem is to be retrieved from its position in the side pocket, the kick-over tool is moved into the pipe to just past the side pocket in which the gas lift valve in question is positioned. The kick-over tool is then carefully pulled back so that, by means of an orienting device, it is rotated about its longitudinal axis into the right direction and is then locked in a desired axial position. U.S. Pat. No. 3,827,490 discloses a kick-over tool and an orienting device of this kind.

By increasing the tightening force on the cable, the intermediate arm is released and, by means of spring force, pivoted together with the stem holder out from the tool body. Then the stem holder is moved towards the valve stem and connected to it, after which the valve stem is pulled out of the gas lift valve.

It has turned out, however, that the connection of the stem holder to the valve stem may be rendered difficult or prevented by, for example, sediments or other undesired material present between the attachment portion of the valve stem and the side pocket wall.

Conventional cleaning techniques, in which pressure fluid and mechanical cleaning tools in the form of, for example, brushes may be used, often do not provide a satisfactory cleaning effect, which may result in an unsuccessful retrieving operation; in the present example, of the valve stem.

The invention has for its object to remedy or reduce at least one of the drawbacks of the prior art.

The object is achieved according to the invention through the features which are specified in the description below and in the claims that follow.

There is provided a method for removing sediments or other undesired material from a cavity in a petroleum well, in which a tool is moved down into the well, the method being characterized by including:

positioning a detonable charge in the tool;

and detonating the charge after the tool has been positioned in the petroleum well.

The method thereby enables cleaning of a cavity in a petroleum well by means of a detonable charge. Detonable charges are used to a considerable extent for perforation operations, and procedures for bringing detonable material into a well are well known to a person skilled in the art.

An opening may be arranged in the tool, the tool being oriented around its longitudinal axis by means of an orienting tool, and the method may thereby include positioning the radial opening relative to the orienting tool, whereby the opening takes a desired direction when the orienting tool is in its active position. The opening may extend radially in the tool.

The operation of the orienting tool is well known to a person skilled in the art and is not described any further.

By placing the detonable charge in a radial opening in the tool, the reaction force of the detonable charge will be directed towards the longitudinal axis of the tool. The reaction force is thereby prevented from imparting a torque to the tool during the detonation. Such a torque could over-strain the orienting device and make the opening rotate away from the desired position.

The method may include directing the opening towards the cavity. Thereby the cavity is cleaned by the shock wave that arises during the detonation.

The method may include directing the opening tangentially towards the cavity. If the cavity is formed by a cylinder portion or a portion of an annular space, as is often the case in valve stem cleaning, a tangential shock wave will provide considerable rotation of fluid and loose material present in the cavity. Such an orientation of the radial opening is to be preferred.

For practising the method, there may be used a cleaning tool for removing sediments or other undesired material from a cavity in a petroleum well, a tool being moved down into the well and oriented around its longitudinal axis by means of an orienting tool. The tool is characterized by being provided with an orientable opening for a detonable material. The opening may extend radially in the tool.

The opening may be constituted by a number of radial openings or a groove extending axially in the tool.

An axial groove is well suited for receiving string-shaped detonable material which is placed and secured in the groove in a manner known per se.

In a reasonable, effective and quick way, the method and device according to the invention solve problems in connection with cleaning a cavity in a petroleum well, in particular a cavity to which access is limited.

In what follows, there is described an example of a preferred embodiment which is visualized in the accompanying drawings, in which.

Figure 1:
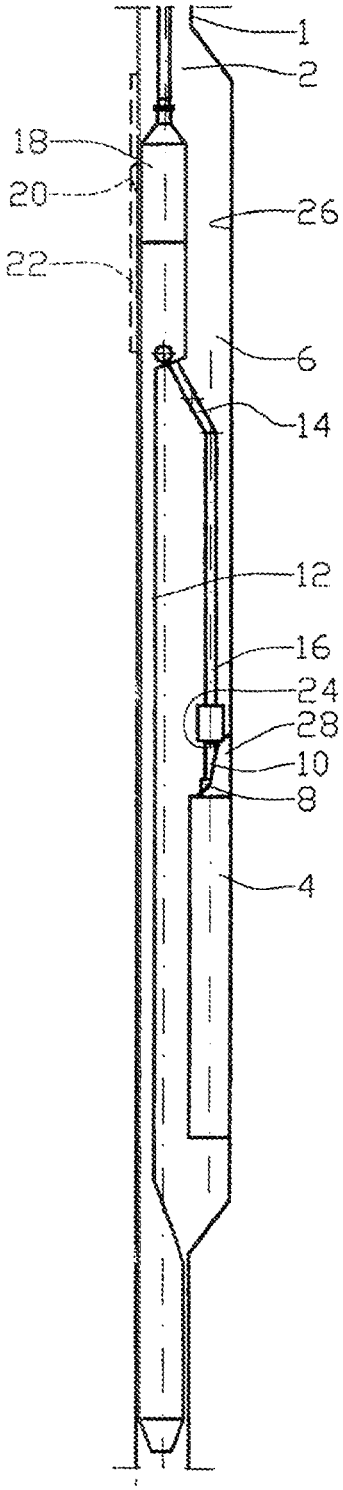
FIG. 1 shows schematically a prior art kick-over tool which is prevented from connecting to a valve stem.

In the drawings the reference numeral 1 indicates tubing which is placed in a petroleum well 2, the tubing 1 including a gas lift valve 4. The gas lift valve 4 is placed in a side pocket 6 of the tubing 1.

The gas lift valve 4 includes a replaceable valve stem 8 which is provided with a connector portion 10.

In FIG. 1 is shown a kick-over tool 12 of a design known per se which includes an intermediate arm 14 and a stem holder 16. The kick-over tool 12 includes an orienting tool 18 with an orienting body 20. The orienting body 20 has been moved into engagement with an orienting groove 22 in the tubing 1. As mentioned in the general part of the specification, the construction and operation of an orienting tool 18 is known and not described any further.

The intermediate arm 14 and stem holder 16 of the kick-over tool 12 have been moved into the side pocket 6 to be able to connect to the connector portion 10. However, in a cavity 24 between the connector portion 10 and the wall 26 of the side pocket, undesired material 28 has built up, preventing the stem holder 16 from engaging the connector portion 10.

Figure 2:
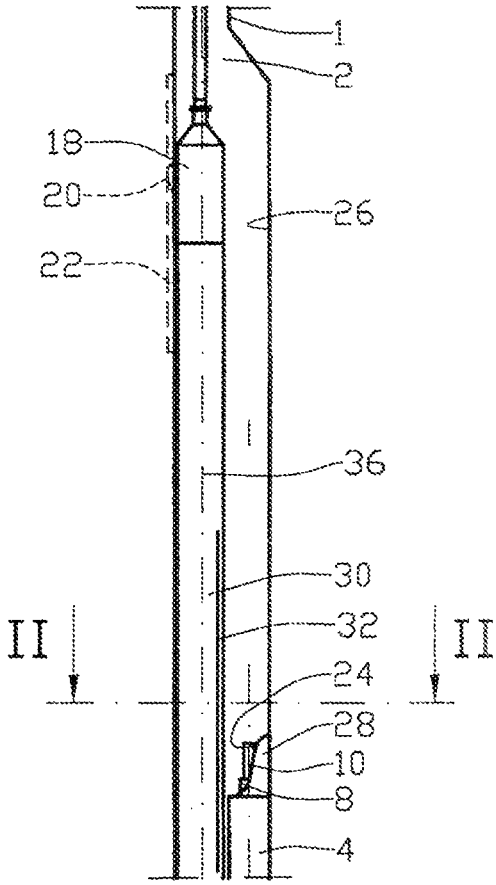
FIG. 2 shows schematically a tool including a detonable charge in position in a petroleum well.

In FIG. 2, a tool 30 which is provided with an opening 32 for detonable material 34 is placed in the tubing 1. The tool 30 may form a separate tool or form part of a combined cleaning and kick-over tool, not shown.

Figure 3:
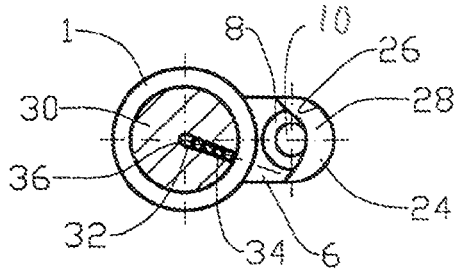
FIG. 3 shows a section II-II of FIG. 2 on a larger scale.

The tool 30 which has a longitudinal axis 36 has been oriented by means of the orienting tool 18, the opening 32, which is formed by a longitudinal groove in the tool 30, being directed tangentially towards the cavity 24, see FIG. 3.

When the detonable material 34 is detonated, the reaction force from the detonation acts through the longitudinal axis 36. Thereby, the reaction force imparts only inconsiderable torque to the tool 30 which is thereby not rotated during the detonation. The shock wave from the detonation propagates tangentially into the cavity 24, loosening and thereby removing the undesired material 28.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A method of removing sediments or other undesired material from a cavity in a tubing in a petroleum well in which a tool is moved down into the tubing, the method comprises the following steps of:

disposing a detonable charge in an opening in the tool;

providing the tool with an orienting tool comprising an orienting body adapted to engage with an orienting groove in the tubing:

positioning the opening relative to the orienting tool, whereby the opening takes a desired direction when the orienting tool has engaged the orienting groove;

orienting the tool having a longitudinal axis around the longitudinal axis by means of the orienting tool engaging the orienting groove; and detonating the charge after the tool has been positioned in the petroleum well.

2. The method in accordance with claim 1, including the step of directing the opening towards the cavity.

3. The method in accordance with claim 2, including the step of directing the opening secantially towards the cavity.

4. The method in accordance with claim 1, including the step of directing the opening tangentially towards a valve stem in the cavity.

5. A tool for removing sediments or other undesired material from a cavity in a tubing in a petroleum well said tool comprising an orienting tool comprising, an orienting body adapted to engage with an orienting groove in the tubing, said tool comprising an opening for a detonable material with a relative position to the orienting tool, and said tool comprising detonable material within the opening.

6. The device in accordance with claim 5, wherein the opening extends radially in the tool.

7. The device in accordance with claim 5, wherein the opening is formed by a groove which runs axially in the tool.

* * * * *